United States Patent [19]

Saito et al.

[11] 4,069,297

[45] Jan. 17, 1978

[54] PROCESS FOR PRODUCING CARBON FIBERS

[75] Inventors: Kazuhisa Saito; Hiroyasu Ogawa, both of Shizuoka, Japan

[73] Assignee: Toho Beslon Co., Ltd., Tokyo, Japan

[21] Appl. No.: 674,244

[22] Filed: Apr. 6, 1976

[30] Foreign Application Priority Data

Apr. 8, 1975 Japan ..... 50-42444

[51] Int. Cl.[2] ..... D01F 9/12

[52] U.S. Cl. ..... 423/447.6; 423/447.7

[58] Field of Search ..... 423/447.6, 447.7, 447.8; 264/29.6, 29.7

[56] References Cited

U.S. PATENT DOCUMENTS

| | | | |
|---|---|---|---|
| 3,529,934 | 9/1970 | Shindo | 423/447.6 |
| 3,552,923 | 1/1971 | Carpenter et al. | 423/447.6 |
| 3,556,729 | 1/1971 | Holsten et al. | 423/447.6 |
| 3,705,236 | 12/1972 | Ishikawa et al. | 423/447.6 |
| 3,764,662 | 10/1973 | Roberts, Jr. | 423/447.6 |
| 3,900,556 | 8/1975 | Clarke | 423/447.7 |
| 3,914,394 | 10/1975 | Fukushima et al. | 423/447.8 |
| 3,914,960 | 10/1975 | McGuffin et al. | 423/447.8 |
| 3,933,986 | 1/1976 | Matsumura et al. | 423/447.8 |
| 3,935,301 | 1/1976 | Morita et al. | 423/447.6 |
| 3,954,950 | 5/1976 | Ram et al. | 423/447.6 |

FOREIGN PATENT DOCUMENTS

| | | | |
|---|---|---|---|
| 1,336,123 | 11/1973 | United Kingdom | 423/447.6 |

*Primary Examiner*—O. R. Vertiz
*Assistant Examiner*—Wayne A. Langel
*Attorney, Agent, or Firm*—Sughrue, Rothwell, Mion, Zinn and Macpeak

[57] ABSTRACT

A process for continuously producing carbon fibers which comprises preoxidizing polyacrylonitrile fibers containing at least about 90% by weight of acrylonitrile at a temperature of about 200° to about 300° C in an oxidizing atmosphere while allowing the fibers to shrink about 40 to about 70% (of the free shrinkage of the fibers determined under a load of 1 mg/d) with the progress of preoxidation; then carbonizing the preoxidized fibers at about 500° to about 1,000° C in a non-oxidizing atmosphere so that the shrinkage of the fibers finally becomes about 40 to about 70% (of the free shrinkage of the preoxidized fibers determined when the fibers are placed under a load of 1 mg/d and heated at 1,000° C for 15 minutes); and then heat treating the carbonized fibers at constant length at a temperature of up to about 3,000° C in a non-oxidizing atmosphere.

20 Claims, 5 Drawing Figures

PROCESS FOR PRODUCING CARBON FIBERS

BACKGROUND OF THE INVENTION

1. Field of the Invention

This invention relates to a process for continuously and stably producing tows of carbon filaments having a high tenacity and Young's modulus and reduced fuzzing from polyacrylonitrile fibers as a raw material.

2. Description of the Prior Art

Many techniques, including those disclosed in Japanese Patent No. 304,892 and U.S. Pat. No. 3,285,696, have heretofore been suggested for producing carbon fibers from polyacrylonitrile fibers as a raw material. It is generally known that, in these techniques, the fibers are preoxidized in an oxidizing atmosphere at 200° to 300° C prior to carbonization. It is also known from U.S. Pat. No. 3,412,062, for example, that the application of tension to the fibers in the preoxidation step is effective to obtain carbon fibers having high tenacity and Young's modulus. These prior art techniques, however, fail to continuously produce carbon fibers of good quality in regard to tenacity, elasticity and filament breakage.

SUMMARY OF THE INVENTION

It is an object of this invention to provide a process for producing carbon fibers of good tenacity and Young's modulus by a stable operation which does not involve the troubles ascribable to filament breakage encountered in the prior art.

We made extensive investigations on the structural characteristics of polyacrylonitrile fibers as a raw material, changes in the structure of the fibers during preoxidation, and their heat shrinkage behavior. These investigations led to the discovery that when the speed of, e.g., rollers is predetermined so as to allow the fibers to shrink about 40 to about 70% of the free shrinkage of the fibers during preoxidation and carbonization, the process proves to be superior in respect of equipment, operation and product quality.

The present invention thus provides a process for continuously producing carbon fibers which comprises preoxidizing polyacrylonitrile fibers containing at least about 90% by weight of acrylonitrile units at a temperature of about 200° to about 300° C in an oxidizing atmosphere while allowing the fibers to shrink about 40 to about 70% (based on the free shrinkage of the fibers determined under a load of 1 mg/d) with the progress of the preoxidation; then carbonizing the preoxidized fibers at about 500° to about 1,000° C in a non-oxidizing atmosphere so that the shrinkage of the fibers finally becomes about 40 to about 70% (based on the free shrinkage of the preoxidized fibers determined when the fibers are placed under a load of 1 mg/d and heated at 1,000° C for 15 minutes), and heat treating the carbonized fibers at constant length at a temperature of up to about 3,000° C in a non-oxidizing atmosphere.

DETAILED DESCRIPTION OF THE INVENTION

Figure 1:
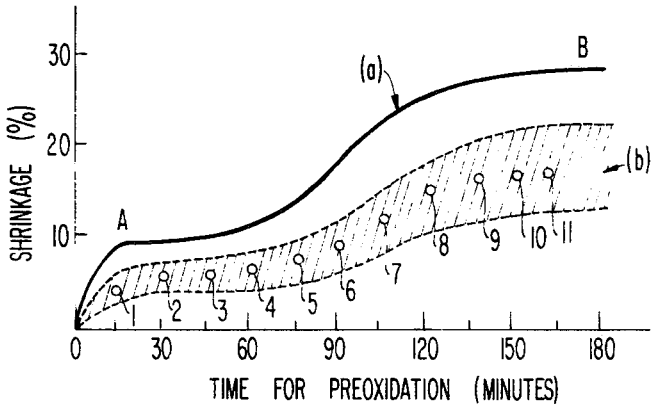
FIGS. 1 and 4 are schematic representations of the relationship between the free shrinkage and the treating time in the preoxidation of polyacrylonitrile fibers [shown by curves (a) and (a'), respectively] and the range of about 40 0 to about 70% shrinkage based on the free shrinkage (hatched portion)

The polyacrylonitrile fibers used in this invention are fibers of a homopolymer of acrylonitrile, or an acrylonitrile copolymer containing at least about 90% by weight of acrylonitrile. These polymers have a degree of polymerization of generally about 500 to about 3,000, preferably 1,000 to 2,000.

Comonomers used for copolymer formation are vinyl compounds copolymerizable with acrylonitrile, for example, acrylates such as methyl acrylate or butyl acrylate, methacrylates such as methyl methacrylate, vinyl acetate, acrylamide, N-methylolacrylamide, acrylic acid, methacrylic acid, vinylsulfonic acids, allylsulfonic acid, methallylsulfonic acid and salts of such acids, usually the sodium salts.

The acrylonitrile polymer is produced by known methods, for example, suspension polymerization in an aqueous system, emulsion polymerization, or solution polymerization in a solvent.

The acrylonitrile fibers can be prepared by known methods. The spinning can be carried out by a dry or wet method. Useful spinning solvents are inorganic solvents such as a concentrated aqueous solution of zinc chloride or conc. nitric acid, or organic solvents such as dimethylformamide, dimethylacetamide or dimethylsulfoxide.

Generally, wet spinning includes a combination of coagulation, washing, stretching, shrinking, and drying. Our investigations have showed that fibers obtained by the steps of coagulation, washing and drying and then stretching the dried fibers in saturated steam are especially preferred for use in the preoxidation treatment in the process of this invention so as to produce a carbon fiber having a high molecular orientation and a high tensile strength.

In the case of this spinning process, a drying temperature of about 100° to about 160° C, saturated steam at a temperature of about 110° to about 130° C and total stretching ratio of about 10 to about 20 are preferred.

The size of fibers treated in accordance with the present invention is not especially limited, and, in general, fibers as are commercially available can be treated with ease in accordance with the present invention. For example, typically commercial fibers comprise from about 100 to about 500,000 filaments per strand, and each filament has a size on the order of 0.5 to about 10 denier; hundreds of strands are treated in the case of small size strands, of course.

The preoxidation temperature for the polyacrylonitrile fibers is about 200° to about 300° C, although varying according to the composition of the fibers and the type of the ambient atmosphere. If the temperature is above about 300° C, the fibers burn or deteriorate, while if it is below about 200° C, very long periods are required for the treatment and the preoxidation substantially fails. Typically, the preoxidation is conducted at the above temperature for about 30 minutes to about 5 hours in air.

Generally, the preoxidation treatment is carried out in air, but an oxygen containing gas with an oxygen content of more than about 15% by volume, for example, a mixture of oxygen and nitrogen, can also be used.

The preoxidation treatment is carried out until the oxygen content of the polyacrylonitrile fibers becomes about 5 to about 15% by weight, preferably 8 to 12% by weight. Usually, the starting oxygen content of any acrylonitrile copolymer is less than about 3 weight %; theoretically, in the case of polyacrylonitrile, it is 0%.

When oxygen combines with the fibers to the point of saturation, the oxygen content of the fibers reaches at least 20%. However, if the oxygen content is more than about 15%, the quality of the treated fibers is reduced, and, consequently, carbonized fibers of low quality result. When the oxygen content is less than about 5%, the yield of the carbonized fibers decreases.

The free shrinkage of the fibers in the preoxidation is the shrinkage of the fibers based on their length before the preoxidation, and the change of the free shrinkage with the progress of the preoxidation is experimentally measured under a load of 1 mg/d under the corresponding preoxidizing conditions. On a commercial scale, prior to the initiation of continuous operation in a plant, the free shrinkage behavior of a sample of the fibers to be treated is experimentally measured under a load of 1 mg/d at a temperature which corresponds to the operation temperature as shown in FIG. 1 (*a*). Based on the free shrinkage behavior, that is, the relationship between time and shrinkage, the rotation rate of each roller in the preoxidation furnace for actual operation is adjusted so as to provide a furnace for actual operation is adjusted so as to provide a shrinkage in the range of about 40 to about 70% of the free shrinkage.

The free shrinkage of the fibers in the carbonization treatment is the shrinkage of the fibers based on their length before carbonization, which is measured when the fibers are placed under a load of 1 mg/d and treated at 1,000° C for 15 minutes in a nitrogen atmosphere.

The free shrinkage of certain fibers in the preoxidation step is schematically shown in FIG. 1 by curve (*a*). The fibers used were obtained by wet spinning a polymer solution composed of 10 parts by weight of a copolymer of 97% by weight of acrylonitrile and 3% by weight of methyl acrylate and 90 parts by weight of a 60% by weight aqueous solution of zinc chloride, washing the spun filaments while being stretched 2.5 x, drying at 130° C, and stretching them 5.0 x in saturated steam of 120° C. The fibers were preoxidized in heated air, and the change of the free shrinkage with time was determined. The results are plotted in FIG. 1, curve (*a*).

It is interpreted that O - A in curve (*a*) represents the heat shrinkage of the polyacrylonitrile fibers themselves, and A - B represents their shrinkage caused by preoxidation through the cyclization and oxidation of the nitrile groups. The free shrinkage behavior of the polyacrylonitrile fibers in the preoxidation step shows the same tendency at different temperatures. The hatched portion in FIG. 1 shows the range of the shrinkage of the fibers employed in the preoxidation treatment in accordance with this invention.

The adjustment of the shrinkage of the fibers at each stage of the preoxidation treatment is conveniently carried out by means of a plurality of rollers whose speed is independently variable when the fibers to be treated are continuous filaments. The speed of each roller is regulated so that the shrinkage of the fibers is within the above specified range. The number of the rollers is optional, but generally at least 5, preferably at least 10, rollers are used. The larger the number of the rollers, the more accurately the shrinkage of the fibers can be controlled.

Figure 2A:
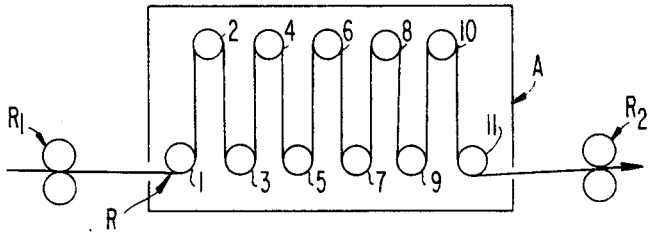
FIGS. 2 (A) and 2 (B) show embodiments of roller arrangements in the preoxidation step.
Figure 2B:
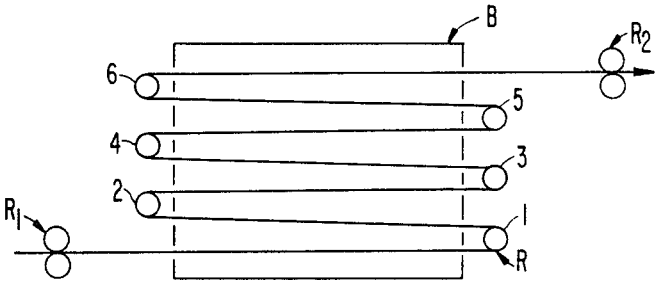

The use of rollers is illustrated in FIG. 2 (A) and FIG. 2 (B). In FIG. 2 (A), the rollers are provided in an oxidizing atmosphere, and in FIG. 2 (B), they are provided outside the treating apparatus. The treating apparatus are furnaces A and B.

In FIG. 2 (A), $R_1$ generally indicates the rollers for introducing the fibers into the treating furnace A, R generally indicates the rollers within the furnace A which are used to regulate the shrinkage of the fibers (the number of rollers generally being indicated by the numerals written thereon, which numerals can be correlated with curve (*b*) in FIG. 1) and $R_2$ indicates take-off rollers for removing the treated fibers from the furnace A.

In FIG. 2 (B), similar terminology and numbering is utilized to identify similar elements.

An experiment was performed in which polyacrylonitrile fibers were preoxidized while being conveyed by a series of rollers, and by varying the speed of each roller, the influences of the roller speed on the free shrinkage of the fibers and their shrinkage during preoxidation were examined. As a result, it has been found that when the preoxidation of the polyacrylonitrile fibers is carried out while allowing the fibers to shrink about 40 to about 70% based on the free shrinkage of the fibers with the progress of the preoxidation, the occurrence of fuzzing due to fiber breakage is reduced, and no process problems are encountered. When the shrinkage of the fibers during preoxidation is outside the range specified above, the occurrence of fuzzing increases along with frequent processing difficulties such as wrapping of the fibers around the rollers which renders the operation unstable.

We have thus confirmed that in order to produce carbon fibers of good quality having high tenacity and elasticity and reduced fuzzing, it is essential to prescribe the shrinkage of the fibers in the preoxidation step so that it has the following relationship to the free shrinkage of the fibers in the preoxidation step.

ca. $40 \leqq S/So \times 100(\%) \leqq$ ca. 70 where So is the free shrinkage and S is the prescribed shrinkage given to the fibers.

This relationship is tabulated below in Table 1.

TABLE 1

| | Proportion Based on the Free Shrinkage | | |
|---|---|---|---|
| | above ca. 70% | ca. 40 to ca. 70% | below ca. 40% |
| State in the preoxidation step | Occurrence of fuzzing is low, and the process step is stable | | High occurrence of fuzzing; wrapping occurs frequently and the process step is unstable |
| Properties of carbon fibers | properties such as tenacity and elasticity reduced | Good tenacity and elasticity | Quality is unstable due to the processing difficulty |

The resultant preoxidized fibers are then carbonized at about 500 ° to about 1,000° C in a non-oxidizing atmosphere. The non-oxidizing atmosphere is generally nitrogen or argon.

The preoxidized polyacrylonitrile fibers obtained by the process of this invention normally have a free shrinkage of about 10 to about 15%. In the present invention, the preoxidized fibers are carbonized in a non-oxidizing atmosphere at a temperature of about 500° to about 1,000° C, preferably 700° to 950° C, so that the fibers finally have a shrinkage of about 40 to about 70% based on the free shrinkage of the fibers measured by the method described hereinabove. The carbonization is carried out until the carbon content of the fibers becomes at least about 75% by weight, preferably at least 85% by weight (typically, the starting carbon percentage of the materials processed in accordance with the present invention is on the order of about 60 to about 65% by weight, though this is not limitative), as a result of the volatile components in the preoxidized fibers being removed. This heat treatment is generally carried out for about 30 seconds to about 30 minutes. While the non-oxidizing atmosphere selected for the carbonization is not limited in any special fashion, considering cost, typically nitrogen is used.

When a shrinkage higher than about 70% based on the free shrinkage is imparted to the fibers during carbonization, the degree of orientation of the fibers is reduced, and carbon fibers having high tenacity and elasticity cannot be obtained. If the shrinkage is less than about 40%, fuzzing frequently occurs and the process step becomes unstable, thus causing increased product non-uniformity.

In a manner similar to that utilized for the preoxidation free shrinkage, prior to continuous operation in a plant the free shrinkage of the preoxidized fiber to be carbonized is experimentally measured under a load of 1 mg/d at 1,000° C for 15 minutes in a non-oxidizing atmosphere (nitrogen). Based on the free shrinkage value determined, the rotation speeds of the rollers which are positioned at the front and at the rear of the carbonization furnace are adjusted so as to provide a shrinkage in the range of about 40 to about 70% of the free shrinkage.

Any apparatus can be used for carbonization which permits the adjustment of the shrinkage of the fibers in the above mentioned manner. Generally, a furnace equipped with two rollers having a pre-adjusted speed ratio suffices.

The fibers carbonized in the above manner are further heat treated at constant length at a temperature of up to about 3,000° C, generally higher than about 1,000° to about 2,000° C, for about 30 seconds to about 30 minutes in a non-oxidizing atmosphere. The non-oxidizing atmosphere selected is not especially limited in any fashion, but again, considering cost, typically nitrogen is used.

As described above, the present invention originated from an extensive study of the structure and properties of polyacrylonitrile fibers as a raw material for carbon fibers, and has made it possible to produce carbon fibers of good quality continuously and stably on a commercial scale as a result of combining the above specified steps of preoxidation, carbonization, and heat treatment.

The following Examples illustrate the present invention more specifically; they are not to be construed as limitative, however.

EXAMPLE 1

9.7 parts by weight of acrylonitrile and 0.3 parts by weight of methyl acrylate were polymerized in a conventional manner at 50° C in 90 parts by weight of a 60% by weight aqueous solution of zinc chloride using sodium sulfite and sodium persulfate as catalysts. The degree of polymerization of the polymer thus obtained was 1,560.

The polymer solution was spun into a coagulating bath composed of a 30% aqueous solution of zinc chloride at 10° C using a spinneret with 6,000 holes each having a diameter of 0.07 mm. The spun filaments were washed with water while being stretched 2.5 ×, and then dried at 130° C. The filaments were then stretched at a stretch ratio of 5 in saturated steam at 120° C to form a tow of filaments with a single filament denier of 1.5.

When the resulting filaments were heated in air at 250° C, their free shrinkage changed as shown in FIG. 1 by curve (*a*).

A preoxidizing apparatus including rollers arranged as shown in FIG. 2 (A) was used. The speeds of the rollers were prescribed so that they met curve (*b*) in FIG. 1. The diameter of each roller was 20 cm, and the distance between the upper roller unit and the lower unit was 3 meters.

Total shrinkage of the fiber during preoxidation processing was 15% which corresponded to 53.6% of the free shrinkage.

Under the above conditions, the filaments were preoxidized in air at atmospheric pressure continuously at 250° C for 3 hours to form preoxidized filaments having an oxygen content of 11%.

Figure 3:
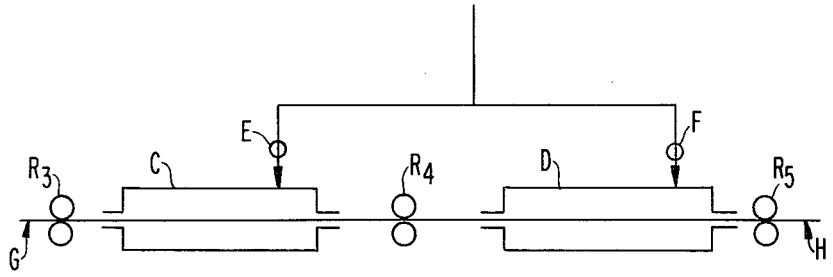
FIG. 3 is a schematic view of apparatus for carbonizing the preoxidized fibers and treating the carbonized fibers at constant length.

The preoxidized filaments were than carbonized in an atmosphere of nitrogen at a pressure slightly above atmospheric to prevent the inflow of exterior air at 900° C for 5 minutes using a carbonization furnace of the type shown in FIG. 3 so that the shrinkage of the filaments was adjusted to 7% (which corresponds to 50% of the free shrinkage (14%)) by adjusting the speeds of rollers $R_3$ and $R_4$ positioned in front, and at the rear, of furnace C. The peripheral speed of roller $R_3$ was 10.2 m/hr, which is the same as the peripheral speed of roller $R_2$ (in FIG. 2 (A)). The peripheral speed of roller $R_4$ was 9.5 m/hr. In FIG. 3, E and F represent a nitrogen gas introducing pipe and G the preoxidized filaments.

The carbonized filaments were then treated at constant length by setting the rate of rotation of rollers $R_4$ and $R_5$ as shown in FIG. 3 to be the same in an atmosphere of nitrogen at a pressure slightly above atmospheric to prevent the inflow of exterior air at 1,500° C for 5 minutes in furnace D as shown in FIG. 3. Thus, carbon fibers of good quality free from fuzzing were produced in a stable fashion. In FIG. 3, H represents carbonized filaments.

The resulting carbon filaments had a tensile strength of 250 kg/mm$^2$ and a tensile modulus of elasticity of 24.5 × 10$^3$ kg/mm$^2$.

EXAMPLE 2

94 parts by weight of acrylonitrile, 3 parts by weight of N-methylolacrylamide and 3 parts by weight of acrylic acid were polymerized using sodium persulfate as a catalyst at 55° C in 1,000 parts by weight of a concentrated salt solution comprising 500 parts by weight of zinc chloride and 80 parts by weight of sodium chloride.

The polymer solution thus obtained was spun into a coagulating bath composed of a 25% salt solution at 15° C using a spinneret with 3,000 holes each having a diameter of 0.06 mm. The spun filaments were washed while being stretched 3.0 ×, and then dried at 140° C, and stretched at a stretch ratio of 5.5 in saturated steam at 115° C. The fiber thus obtained had a single filament denier of 1.0, a tensile strength of 6.5 g/d and a tensile elongation of 12%.

Figure 4:
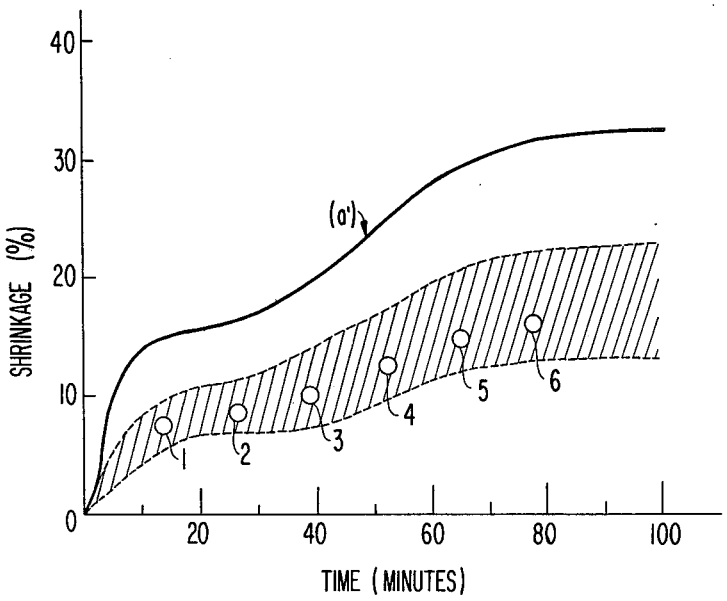

When the resulting filaments were heated in air at 260° C, their free shrinkage changed as shown in FIG. 4 by curve (*a'*).

150 strands of the filaments were preoxidized at 260° C for 90 minutes in air using the furnace shown in FIG. 2 (B).

Points marked with 1 – 6 in FIG. 4 represent the shrinkage which was set by adjustment of the speed of rollers 1 –6 in the preoxidation furnace, that is, the speed of the rollers was adjusted so as to shrink the fiber about 50% of the free shrinkage. The total shrinkage of the fiber was 16%. The preoxidized filaments were than continuously carbonized in nitrogen at 850° C for 10 minutes where the speed of rollers in front and at the rear of the carbonization furnace was adjusted so as to shrink the fiber about 60% of the free shrinkage. The free shrinkage of the fiber was 13%, and thus the actual shrinkage during carbonization was about 7.8%. The carbonized filaments were further heat treated continuously at constant length in nitrogen at 1,350° C for minutes.

The resulting carbon fiber filaments had monofilament diameter of 8.2 microns, a specific gravity of 1.73, a tensile strength of 245 kg/mm$^2$ and a Young's modulus of 22 tons/mm$^2$. Comparatively little fuzzing was observed.

While the invention has been described in detail and with reference to specific embodiments thereof, it will be apparent to one skilled in the art that various changes and modifications can be made therein without departing from the spirit and scope thereof.

What is claimed is:

1. A process for continuously producing carbon fibers which comprises preoxidizing polyacrylonitrile fibers containing at least about 90% by weight of acrylonitrile at a temperature of about 200° to about 300° C in an oxidizing atmosphere while shrinking the fibers about 40 to about 70% based on the free shrinkage of the fibers determined under a load of 1 mg/d with the progress of preoxidation, said preoxidizing being carried out in a continuous fashion using a plurality of rollers, said free shrinkage being determined under the preoxidizing conditions; then carbonizing the preoxidized fibers at about 500° to about 1,000° C in a non-oxidizing atmosphere so that the shrinkage of the fibers finally becomes about 40 to about 70% based on the free shrinkage of the preoxidized fibers determined when said preoxidized fibers are placed under a load of 1 mg/d and heated at 1,000° C for 15 minutes in a nitrogen atmosphere; and thereafter heating the carbonized fibers at constant length at a temperature of up to about 3,000° C.

2. The process of claim 1, wherein said carbonizing is carried out until the carbon content of the fibers becomes at least about 75% by weight.

3. The process of claim 2, wherein said carbonizing is carried out in nitrogen.

4. The process of claim 3, wherein said heating at constant length is carried out for about 30 seconds to about 30 minutes a non-oxidizing atmosphere.

5. The process of claim 4, wherein said non-oxidizing atmosphere in which said heating at constant length is conducted is nitrogen.

6. The process of claim 2, wherein said carbonizing is carried out for about 30 seconds to about 30 minutes.

7. The process of claim 1 wherein said polyacrylonitrile fibers are fibers of a homopolymer of acrylonitrile or a copolymer of acrylonitrile containing at least about 90% by weight of acrylonitrile.

8. The process of claim 7 wherein said acrylonitrile copolymer is a copolymer of acrylonitrile with at least one member selected from the group consisting of acrylates, methacrylates, vinyl acetate, acrylamide, N-methylolacrylamide, acrylic acid, methacrylic acid, vinylsulfonic acid, allylsulfonic acid, methallylsulfonic acid, and salts of these acids.

9. The process of claim 8 wherein said acrylonitrile copolymer is a copolymer of acrylonitrile and methyl acrylate.

10. The process of claim 7 wherein said polyacrylonitrile fibers are obtained by spinning a polymer solution containing polyacrylonitrile into a coagulating bath, washing and drying the resulting fibers, and then stretching the dried fibers in saturated steam.

11. The process of claim 10 wherein aqueous zinc chloride is used as a solvent for forming said polyacrylonitrile fibers.

12. The process of claim 7, wherein said preoxidizing is carried out until the oxygen content of said polyacrylonitrile fibers becomes about 5 to 15% by weight, when the starting oxygen content of any polyacrylonitrile fiber is less than about 3 weight percent.

13. The process of claim 7, when said shrinkage during said preoxidation is due to the cyclization and oxidation of the nitrile groups present in said polyacrylonitrile fibers.

14. The process of claim 7, wherein said preoxidizing is conducted for about 30 minutes to about 5 hours in air, said carbonizing is conducted for about 30 seconds to about 30 minutes until the carbon content of the fibers becomes at least about 75% by weight, and the heating of the carbonized fibers at constant length is conducted for about 30 seconds to about 30 minutes in a non-oxidizing atmosphere.

15. The process of claim 1, wherein said plurality of rollers are independently speed-variable rollers.

16. The process of claim 7 wherein the number of the rollers is at least 5.

17. The process of claim 1, wherein said preoxidizing is conducted for about 30 minutes to about 5 hours in air.

18. The process of claim 1, wherein said preoxidizing is carried out in an oxygen containing gas with an oxygen content of more than about 15% by volume.

19. The process of claim 1 wherein the heat treatment of the carbonized fibers at constant length is carried out at a temperature of about 1,000° to about 2,000° C.

20. The process of claim 1, wherein said carbonizing is conducted in nitrogen or argon.

* * * * *